US005938801A

United States Patent [19]

Robinson

[11] Patent Number: 5,938,801

[45] Date of Patent: Aug. 17, 1999

[54] POLISHING PAD AND A METHOD FOR MAKING A POLISHING PAD WITH COVALENTLY BONDED PARTICLES

[75] Inventor: Karl M. Robinson, Boise, Id.

[73] Assignee: Micron Technology, Inc., Boise, Id.

[21] Appl. No.: 09/137,349

[22] Filed: Aug. 20, 1998

Related U.S. Application Data

[62] Division of application No. 08/798,001, Feb. 12, 1997, Pat. No. 5,823,855.

[51] Int. Cl.[6] ..... B24B 7/04

[52] U.S. Cl. ..... 51/306; 51/293; 51/298; 451/41

[58] Field of Search ..... 51/293, 298, 306; 451/41, 285, 286, 287, 288, 289

[56] References Cited

U.S. PATENT DOCUMENTS

| | | | |
|---|---|---|---|
| D. 166,100 | 3/1952 | Roop | 30/147 |
| 202,757 | 4/1878 | Reese | 30/147 |
| 2,185,942 | 1/1940 | Frank | 30/147 |
| 3,617,347 | 11/1971 | Kuratomi | 117/69 |
| 4,565,771 | 1/1986 | Lynch et al. | 430/307 |
| 4,954,142 | 9/1990 | Carr et al. | 51/309 |
| 5,127,196 | 7/1992 | Morimoto et al. | 51/165.73 |
| 5,197,999 | 3/1993 | Thomas | 51/298 |
| 5,213,588 | 5/1993 | Wong et al. | 51/293 |
| 5,250,085 | 10/1993 | Mevissen | 51/298 |
| 5,433,650 | 7/1995 | Winebarger | 451/6 |
| 5,672,095 | 9/1997 | Morimoto et al. | 451/41 |
| 5,823,855 | 10/1898 | Robinson | 451/41 |

FOREIGN PATENT DOCUMENTS

| | | |
|---|---|---|
| 0227394 | 7/1987 | European Pat. Off. . |
| 02186656 | 7/1990 | European Pat. Off. . |
| 07135192 | 5/1995 | European Pat. Off. . |
| 0685877A2 | 12/1995 | European Pat. Off. . |
| WO94/04599 | 3/1994 | WIPO . |

*Primary Examiner*—Deborah Jones
*Attorney, Agent, or Firm*—Seed And Berry, LLP

[57] ABSTRACT

The present invention is a polishing pad for use in chemical-mechanical planarization of semiconductor wafers, and a method for making the polishing pad. The polishing pad has a body, molecular bonding links, and abrasive particles dispersed substantially uniformly throughout the body. The body is made from a polymeric matrix material and the molecular bonding links are covalently bonded to the matrix material. Substantially all of the abrasive particles are covalently bonded to at least one molecular bonding link. The molecular bonding links securely affix the abrasive particles to the matrix material to enhance the uniformity of the distribution of the abrasive particles throughout the pad and to substantially prevent the abrasive particles from breaking away from the pad.

33 Claims, 3 Drawing Sheets

POLISHING PAD AND A METHOD FOR MAKING A POLISHING PAD WITH COVALENTLY BONDED PARTICLES

CROSS-REFERENCE TO RELATED APPLICATION

This application is a divisional of pending U.S. patent application Ser. No. 08/798,001, filed Feb. 12, 1997 now U.S. Pat. No. 5,823,855.

TECHNICAL FIELD

The present invention relates to polishing pads used in chemical-mechanical planarization of semiconductor wafers, and, more particularly, to polishing pads with abrasive particles embedded in the body of the pad.

BACKGROUND OF THE INVENTION

Chemical-mechanical planarization ("CMP") processes remove materials from the surface layer of a wafer in the production of ultra-high density integrated circuits. In a typical CMP process, a wafer presses against a polishing pad in the presence of a slurry under controlled chemical, pressure, velocity, and temperature conditions. The slurry solution has abrasive particles that abrade the surface of the wafer, and chemicals that oxidize and/or etch the surface of the wafer. Thus, when relative motion is imparted between the wafer and the pad, material is removed from the surface of the wafer by the abrasive particles (mechanical removal) and by the chemicals in the slurry (chemical removal).

CMP processes must consistently and accurately produce a uniform, planar surface on the wafer because it is important to accurately focus optical or electromagnetic circuit patterns on the surface of the wafer. As the density of integrated circuits increases, it is often necessary to accurately focus the critical dimensions of the photo-pattern to within a tolerance of approximately 0.5 $\mu$m. Focusing the photo-patterns to such small tolerances, however, is very difficult when the distance between the emission source and the surface of the wafer varies because the surface of the wafer is not uniformly planar. In fact, several devices may be defective on a wafer with a non-uniform planar surface. Thus, CMP processes must create a highly uniform, planar surface.

In the competitive semiconductor industry, it is also desirable to maximize the throughput of the finished wafers and minimize the number of defective or impaired devices on each wafer. The throughput of CMP processes is a function of several factors, one of which is the rate at which the thickness of the wafer decreases as it is being planarized (the "polishing rate") without sacrificing the uniformity of the planarity of the surface of the wafer. Accordingly, it is desirable to maximize the polishing rate within controlled limits.

The polishing rate of CMP processes may be increased by increasing the proportion of abrasive particles in the slurry solution. Yet, one problem with increasing the proportion of abrasive particles in colloidal slurry solutions is that the abrasive particles tend to flocculate when they are mixed with some desirable oxidizing and etching chemicals. Although stabilizing chemicals may prevent flocculation of the abrasive particles, the stabilizing chemicals are generally incompatible with the oxidizing and etching chemicals. Thus, it is desirable to limit the proportion of abrasive particles in the slurry solution.

One desirable solution for limiting the proportion of abrasive particles in the slurry is to suspend the abrasive particles in the pad. Conventional suspended particle pads are made by admixin the abrasive particles into a matrix material made from monomer chains. An ionic adhesion catalyst, such as hexamethyldisalizane, may be used to enhance adhesion between the particles and the monomer chains. After the abrasive particles are mixed into the matrix material, the matrix material is cured to harden the pad and suspend the abrasive particles throughout the matrix material. In operation, the suspended abrasive particles in the pad abrade the surface of the wafer to mechanically remove material from the wafer.

One problem with conventional suspended particle polishing pads is that the abrasiveness of the planarizing surface of the pad, and thus the polishing rate of a wafer, varies from one area to another across the surface of the pad. Before the matrix material is cured, the abrasive particles commonly agglomerate into high density clusters, causing a non-uniform distribution of abrasive particles throughout the pad. Therefore, it would be desirable to develop a suspended particle polishing pad with a uniform distribution of abrasive particles throughout the pad.

Another problem with conventional suspended particle polishing pads is that they tend to scratch the surface of the wafer. As the pad planarizes a wafer, the matrix material adjacent to abrasive particles on the planarizing surface of the polishing pad wears down; eventually, some of the abrasive particles break assay from the pad and travel in the slurry. Particles also break away from pads with ionic adhesion catalysts because electrostatic solvents weaken the ionic bonds between the matrix material and the particles. When a large agglomeration of suspended particles breaks away from the pad, it may scratch the surface of the wafer and seriously damage several of the devices on the wafer. Therefore, it would be desirable to develop a pad that substantially prevents abrasive particles from breaking away from the pad.

SUMMARY OF THE INVENTION

The inventive polishing pad is used for planarizing semiconductor wafers with a CMP process; the polishing pad has a body, molecular bonding links, and abrasive particles dispersed substantially uniformly throughout the body. The body is made from a polymeric matrix material, and the molecular bonding links are covalently attached to the matrix material. Substantially all of the abrasive particles are also covalently bonded to at least one molecular bonding link. The molecular bonding links securely affix the abrasive particles to the matrix material to enhance the uniformity of the distribution of the abrasive particles throughout the pad and to substantially prevent the abrasive particles from breaking away from the pad.

In a method for making the inventive bonded particle polishing pad, molecular bonding links are covalently bonded to abrasive particles. After the molecular bonding links are covalently bonded to the abrasive particles, the bonded molecular bonding links and abrasive particles are admixed with a matrix material in a mold. During the admixing step, reactive terminus groups of the molecular bonding links bond to the matrix material to securely affix the particles to the matrix material. The matrix material is then polymerized to form a pad body with bonded abrasive particles that are suspended substantially uniformly throughout the body.

DETAILED DESCRIPTION OF THE INVENTION

The polishing pad of the present invention has a uniform distribution of abrasive particles throughout the pad, and the abrasive particles are covalently bonded to the pad to substantially prevent the abrasive particles from breaking away from the pad. An important aspect of the present invention is to provide molecular bonding links that covalently bond to both the matrix material of the polishing pad and the abrasive particles. The molecular bonding links perform the following advantageous functions: (1) substantially prevent the abrasive particles from agglomerating before the matrix material is cured; and (2) secure the abrasive particles to the matrix material. The molecular bonding links, therefore, enhance the uniformity of the distribution of the abrasive particles throughout the matrix material and substantially prevent the abrasive particles from breaking away from the polishing pad.

Figure 1:
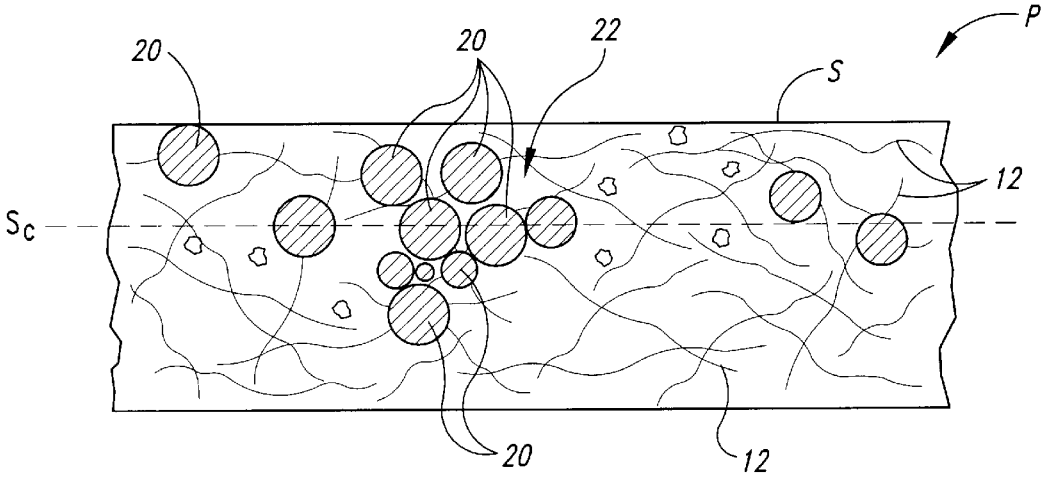
Fig. 1 (PRIOR ART)
FIG. 1 is a partial cross-sectional view of a conventional polishing pad with suspended abrasive particles in accordance with the prior art.

FIG. 1 illustrates a conventional polishing pad P formed from a matrix material 12 and a number of abrasive particles 20. The abrasive particles 20 are suspended in the matrix material 12 while the matrix material 12 is in a liquid state. Before the matrix material 12 cures, the abrasive particles 20 may agglomerate into clusters 22 that reduce the uniformity of the distribution of the abrasive particles 20 throughout the matrix material 12. Thus, when a planarizing surface S of the pad P is conditioned to a new planarizing surface $S_c$, the polishing rate over the cluster 22 of abrasive particles 20 is different than that of other areas on the pad. Additionally, as the matrix material 12 wears down during planarization or conditioning, abrasive particles 20 near the planarizing surface tend to break away from the pad P and scratch a wafer (not shown). Thus, conventional suspended particle polishing pads may provide erratic polishing rates and damage the wafers.

Figure 2:
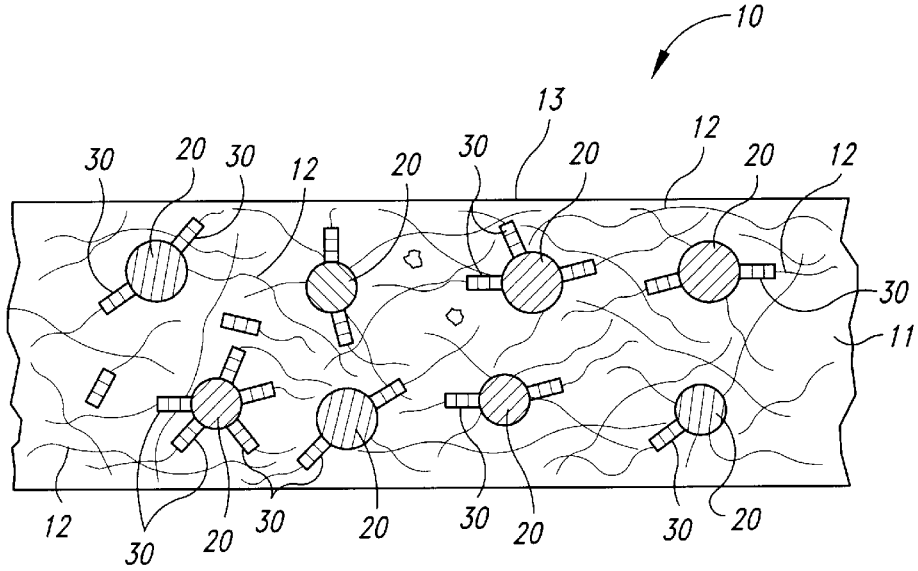
FIG. 2 is a partial schematic cross-sectional view of a polishing pad with bonded, suspended particles in accordance with the invention.

FIG. 2 illustrates a polishing pad 10 in accordance with the invention. The polishing pad 10 has a body 11 made from a matrix material 12. The matrix material 12 is generally polyurethane or nylon. The above-listed polymeric materials are merely exemplary, and thus other polymeric matrix materials are within the scope of the invention. The molecular bonding links 30 covalently bond to the matrix material 12 and the abrasive particles 20. The molecular bonding links 30, therefore, secure the abrasive particles 20 to the matrix material 12. The abrasive particles 20 are preferably made from silicon dioxide or aluminum oxide, but other types of abrasive particles are within the scope of the invention.

Figure 3:
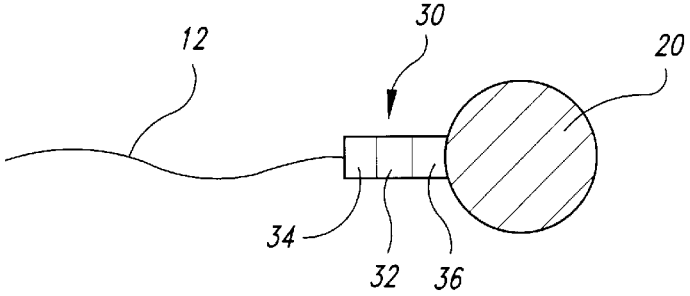
FIG. 3 is a schematic view of a molecular bonding link and an abrasive particle in accordance with the invention.

FIG. 3 further illustrates the bond between a strand of matrix material 12, a bonding link 30, and an abrasive particle 20. The molecular bonding link 30 has an alkyl chain 32, a reactive terminus group 34, and a particle affixing group 36. The reactive terminus group 34 is a molecular segment that bonds the bonding link 30 to the strand of the matrix material 12. The specific structure of the reactive terminus group 34 is selected to reactively bond with the specific type of matrix material 12 when the matrix material 12 is in a liquid monomer phase. The particle affixing group 36 is another molecular segment that covalently bonds the bonding link 30 to the abrasive particle 20. The specific structure of the particle affixing group 36 is similarly selected to covalently bond with the material from which the abrasive particles 20 are made. Accordingly, the molecular bonding link 30 securely attaches the abrasive particle 20 to the matrix material 12.

Figure 4A:
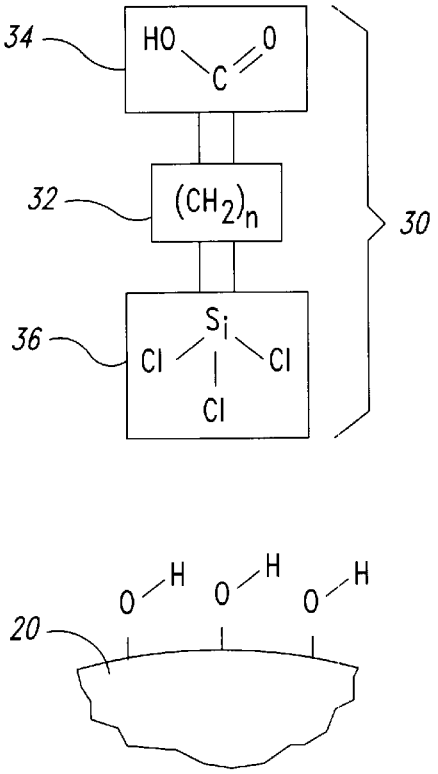
FIG. 4A is a chemical diagram of a molecular bonding link and abrasive particle in accordance with the invention.
Figure 4B:
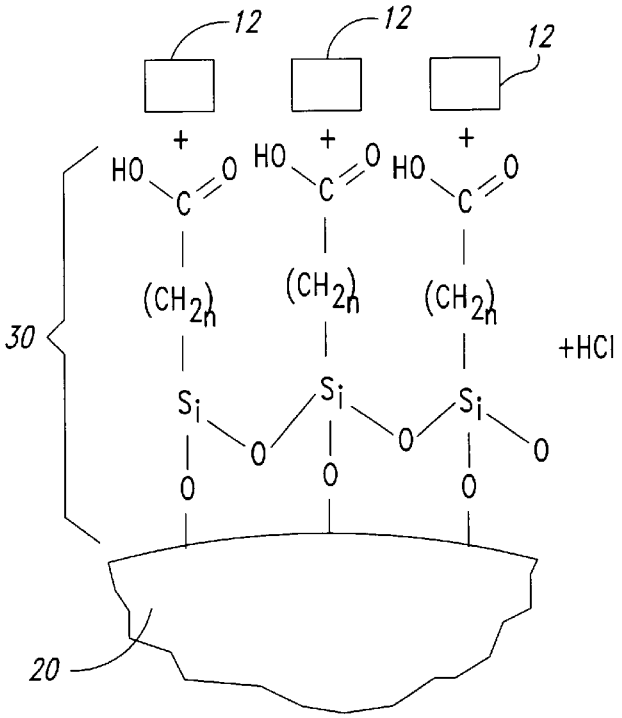
FIG. 4B is a chemical diagram of the reaction between a molecular bonding link and an abrasive particle in accordance with the invention.

FIG. 4A illustrates a specific embodiment of the molecular bonding link 30. The alkyl chain 32 is made from $(CH_2)_n$, where n=1–30, the reactive terminus group is made from COOH, and the particle affixing group is made from trichlorosilane. Referring to FIG. 4B, the trichlorosilane molecule reacts with the O—H chains on the surface of the particle 20 to covalently bond the abrasive particle 20 to the particle affixing group 36 of the molecular bonding link 30. Similarly, the COOH reactive terminus group 34 reacts with a urethane monomer chain 12 to bond the bonding link 30 to the matrix material 12. The byproducts of the reaction are water and hydrochloric acid.

The invention is not limited to abrasive particles made from silicon dioxide or a matrix material made from polyurethane. The materials from which the abrasive particles and the matrix material are made can be varied to impart desired characteristics to the pad. A central aspect of the invention is to select molecular bonding links that covalently bond to the abrasive particles and matrix material to substantially prevent the bonds between the matrix material, molecular bonding links, and abrasive particles from weakening in the presence of an electrostatic solvent. Additionally, the length of the alkyl chain 32 of the molecular bonding link 30 may be varied to accommodate different sizes of abrasive particles 20. For example, an alkyl chain 15–20 Å in length (approximately twelve carbon atoms $(CH_2)_{12}$) may be used with a 1,500 Å diameter particle. Longer alkyl chains 32 are preferably used with larger abrasive particles 20, and shorter alkyl chains 32 are preferably used with smaller abrasive particles 20.

Figure 5:
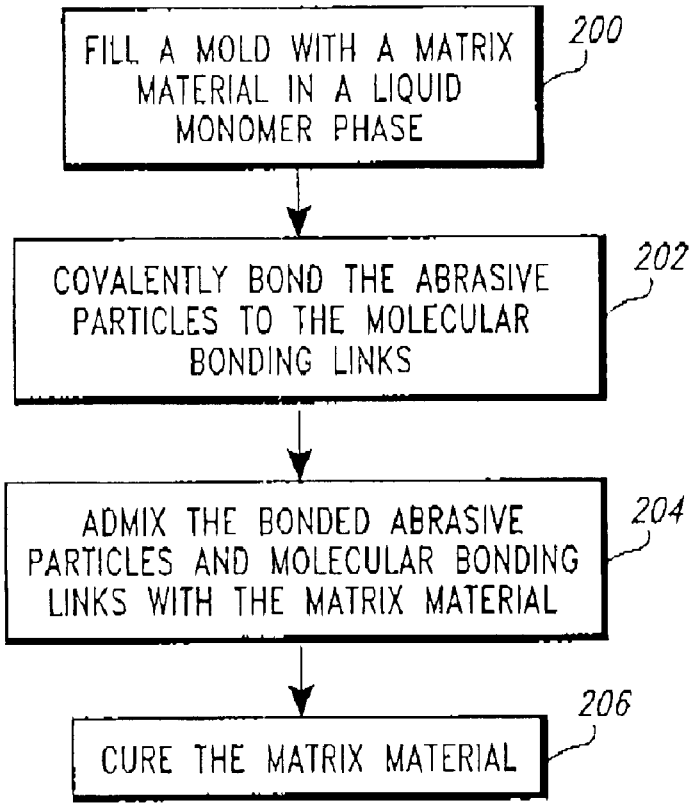
FIG. 5 is a flow chart illustrating a method of making a polishing pad with bonded, suspended particles in accordance with the invention.

FIG. 5 graphically illustrates a method for making bonded particle polishing pads for use in chemical-mechanical planarization of semiconductor wafers in accordance with the invention. The first step 200 of the method is to fill a mold with a matrix, material in a liquid monomer phase. The second step 202 is to covalently bond abrasive particles to molecular bonding links. Depending upon the desired length of the molecular bonding links, they are deposited onto the abrasive particles either by vapor deposition (shorter lengths) or by liquid deposition (longer lengths). The third step 204 is to admix the bonded molecular bonding links and abrasive particles with the matrix material. The pad is made from approximately 10%–50% by weight abrasive particles and bonding links, and approximately 50%–90% by weight matrix material 12. In a preferred embodiment, the pad is made from approximately 15%–25% by weight of bonded abrasive particles and bonding links. After the bonded abrasive particles and molecular bonding links are disbursed substantially uniformly throughout the matrix material, the fourth step 206 is to cure the matrix material.

One advantage of the present invention is that the polishing pad results in a high polishing rate without limiting the oxidizing or etching chemicals in the slurry. By putting the abrasive particles 20 in the pad 10, stabilizing agents are not required in the slurry solution. Accordingly, a wider range of etching and oxidizing chemicals may be used in the slurry solution.

Another advantage of the present invention is that the polishing pad 10 has a uniform polishing rate across its planarizing surface. By bonding the abrasive particles 20 to the matrix material 12, the abrasive particles 20 do not agglomerate into large clusters 22, as shown in FIG. 1. The polishing pad 10, therefore, has a substantially uniform distribution of abrasive particles 20 throughout the matrix material. Thus, the polishing rate is substantially uniform across the surface of the wafer.

Still another advantage of the invention is that the polishing pad 10 does not create large scratches on the surface of a wafer. By covalently bonding the abrasive particles 20 to the matrix material 12, the abrasive particles 20 do not readily break away from the pad 10 in the presence of an electrostatic solvent. Thus, compared to conventional pads, large clusters 22 of abrasive particles 20 are less likely to break away from the pad 10 and scratch a wafer during planarization.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A method for making a bonded particle polishing pad for use in chemical-mechanical planarization of semiconductors wafers, comprising the steps of:

filling a mold with a matrix material;

covalently bonding abrasive to bonding molecules, each bonding molecule having a reactive terminus group for covalently bonding the bonding molecule to the matrix material and a particle affixing group for covalently bonding the bonding molecule to an abrasive particle;

admixing the bonded abrasive particles and bonding molecules with the matrix material, the bonding molecules covalently bonding to the matrix material to securely affix the abrasive particles to the matrix material; and curing the matrix material to form a pad body with bonded abrasive particles that are suspended substantially uniformly throughout the body.

2. The method of claim 1 wherein the matrix material is made from a polymeric material.

3. The method of claim 1 wherein the admixing step comprises admixing 10% to 50% by weight of bonded abrasive particles and bonding molecules with the matrix material.

4. The method of claim 1 wherein each particle affixing group is a non-hydrolyzed molecule segment, and wherein the covalent bonding step comprises depositing the bonding molecules with non-hydrolyzed particle affixing groups on abrasive particles with surface-pendent O—H groups to bond the non-hydrolyzed particle affixing groups to the surface-pendent O—H groups.

5. The method of claim 1 wherein the covalent bonding step comprises depositing the bonding molecules on the abrasive particles with a vapor deposition process.

6. The method of claim 1, wherein the abrasive particles comprise silicon dioxide.

7. The method of claim 1, wherein the abrasive particles comprise aluminum dioxide.

8. The method of claim 1 wherein the admixing step comprises mixing approximately 10–50% by weight abrasive particles with approximately 50–90% by weight matrix material.

9. The method of claim 1 wherein the admixing step comprises mixing approximately 15–25% by weight abrasive particles with approximately 75–85% by weight matrix material.

10. The method of claim 1 wherein the admixing step comprises mixing approximately 10% by weight abrasive particles with approximately 90% by weight matrix material.

11. The method of claim 1 wherein the particle affixing group comprises trichlorosilane, and wherein the covalent bonding step comprises depositing the bonding molecules with trichlorosilane particle affixing groups on abrasive particles with surface-pendent O—H groups.

12. The method of claim 11, wherein the abrasive particles comprise silicon dioxide.

13. The method of claim 11, wherein the abrasive particles comprise aluminum dioxide.

14. The method of claim 1 wherein:

the matrix material comprises a polymeric material that is in a monomer state prior to the curing step;

each bonding molecule comprises an alkyl chain between the reactive terminus group and the particle affixing group, and each particle affixing group comprises a non-hydrolyzed molecule segment; and the admixing step comprises bonding the reactive terminus groups to monomer strands of matrix material.

15. The method of claim 14 wherein the matrix material comprises a urethane, the reactive terminus groups comprise COOH, and the particle affixing groups comprise trichlorosilane, and wherein the covalently bonding step comprises depositing the bonding molecules with trichlorosilane particle affixing groups on oxide abrasive particles prior to the admixing step.

16. The method of claim 15, wherein the abrasive particles comprise silicon dioxide.

17. The method of claim 15, wherein the abrasive particles comprise aluminum dioxide.

18. The method of claim 15 wherein the curing step comprises polymerizing the urethane after the admixing step.

19. A method for making a bonded particle polishing pad for use in chemical-mechanical planarization of semiconductor wafers, comprising the steps of:

filling a mold with a matrix material;

covalently bonding abrasive particles to bonding molecules, each bonding molecule having a reactive terminus group for covalently bonding the bonding molecule to the matrix material and a non-hydrolyzed particle affixing group for covalently bonding the bonding molecule to an abrasive particle;

admixing the bonded abrasive particles and bonding molecules with the matrix material, the bonding molecules covalently bonding to the matrix material to securely affix the abrasive particles to the matrix material; and curing the matrix material to form a pad body with bonded abrasive particles that are dispersed in the body.

20. The method of claim 19 wherein:

the matrix material comprises a polymeric material that is in a monomer state prior to the curing step;

each bonding molecule further comprises an alkyl chain between the reactive terminus group and the particle affixing group; and the admixing step comprises bonding the reactive terminus groups to monomer strands of matrix material.

21. The method of claim 20 wherein the matrix material comprises a urethane, the reactive terminus groups comprise COOH, and the particle affixing groups comprise trichlorosilane, and wherein the covalently bonding step comprises depositing the bonding molecules with trichlorosilane particle affixing groups on oxide abrasive particles prior to the admixing step.

22. The method of claim 21, wherein the abrasive particles comprise silicon dioxide.

23. The method of claim 21, wherein the abrasive particles comprise aluminum dioxide.

24. The method of claim 21 wherein the curing step comprises polymerizing the urethane after the admixing step.

25. The method of claim 21 wherein the covalent bonding step comprises depositing the bonding molecules on the abrasive particles with a vapor deposition process.

26. The method of claim 25 wherein the abrasive particles comprise silicon dioxide.

27. The method of claim 25, wherein the abrasive particles comprise aluminum dioxide.

28. The method of claim 25 wherein the curing step comprises polymerizing the urethane after the admixing step.

29. A method for making a bonded particle polishing pad for use in chemical-mechanical planarization of semiconductor wafers, comprising the steps of:

filling a mold with a matrix material;

covalently bonding abrasive particles to bonding molecules, the abrasive particles having an average particle size of less than approximately 0.15 $\mu$m, and each bonding molecule having a reactive terminus group for covalently bonding the bonding molecule to the matrix material and a non-hydrolyzed particle affixing group for covalently bonding the bonding molecule to an abrasive particle;

admixing the bonded abrasive particles and bonding molecules with the matrix material, the bonding molecules covalently bonding to the matrix material to securely affix the abrasive particle to the matrix material; and curing the matrix material to form a pad body with bonded abrasive particles.

30. The method of claim 29 wherein:

the matrix material comprises a polymeric material that is in a monomer state prior to the curing step;

each bonding molecule comprises an alkyl chain between the reactive terminus group and the particle affixing group; and the admixing step comprises bonding the reactive terminus groups to monomer strands of matrix material.

31. The method of claim 30 wherein the matrix material comprises a urethane, the reactive terminus groups comprise COOH, and the particle affixing groups comprise trichlorosilane, and wherein the covalently bonding step comprises depositing the bonding molecules with trichlorosilane particle affixing groups on oxide abrasive particles prior to the admixing step.

32. The method of claim 31, wherein the abrasive particles comprise silicon dioxide.

33. The method of claim 31, wherein the aluminum particles comprise aluminum dioxide.

* * * * *

UNITED STATES PATENT AND TRADEMARK OFFICE

CERTIFICATE OF CORRECTION

PATENT NO. : 5,938,801
DATE : August 17, 1999
INVENTORS : Karl M. Robinson

It is hereby certified that error appears in the above-identified patent and that said Letters Patent are hereby corrected as shown below:

Column 5, line 30 reads, "conductors" should read - - conductor - -

Signed and Sealed this

First Day of May, 2001

*Attest:*

Nicholas P. Godici

NICHOLAS P. GODICI

*Attesting Officer*

*Acting Director of the United States Patent and Trademark Office*